United States Patent [19]

Bruck

[11] Patent Number: 4,669,764

[45] Date of Patent: Jun. 2, 1987

[54] LATCHING MECHANISM FOR A PIVOTALLY MOUNTED DOOR

[75] Inventor: Gary A. Bruck, Fraser, Mich.

[73] Assignee: Chrysler Motors Corporation, Highland Park, Mich.

[21] Appl. No.: 842,972

[22] Filed: Mar. 24, 1986

[51] Int. Cl.[4] ..... E05C 19/02

[52] U.S. Cl. ..... 292/85; 292/341.17; 292/DIG. 4

[58] Field of Search ..... 292/85, 341.17, 80, 292/92, 201, 231, 122, DIG. 4

[56] References Cited

U.S. PATENT DOCUMENTS

| | | | |
|---|---|---|---|
| 1,738,531 | 12/1929 | Grace | 292/DIG. 4 X |
| 1,828,082 | 10/1931 | Stonebridge | 292/DIG. 4 X |
| 2,535,639 | 12/1950 | Lauer | 292/DIG. 4 X |
| 2,644,708 | 7/1953 | Poole | 292/341.17 |
| 2,750,219 | 6/1956 | Bleam | 292/DIG. 4 X |
| 3,189,874 | 6/1965 | Mertes | 292/80 |
| 3,854,784 | 12/1974 | Hunt et al. | 292/DIG. 4 X |
| 4,328,985 | 5/1982 | Logan | 292/92 X |

*Primary Examiner*—Richard E. Moore

*Attorney, Agent, or Firm*—Edward A. Craig

[57] ABSTRACT

A latching mechanism for a pivotally mounted door of an interior compartment, such as a compartment of a vehicle, is provided. The latching mechanism includes a latch mountable within the compartment and a striker plate mountable on the door. The latch includes a latching element. The striker plate has catch means to engage the latching element upon pushing of the door to a closed position to thereby latch the door closed. The latch includes spring means which are effective to disengage the latching element upon pushing on the door after the door has first been closed and latched. The latch also includes spring stop means mounted on the door and positioned to block disengagement of the latching element until manually deflected out of the way.

3 Claims, 9 Drawing Figures

LATCHING MECHANISM FOR A PIVOTALLY MOUNTED DOOR

BACKGROUND OF THE INVENTION

1. Field of the Invention

This invention relates to a latching mechanism for a pivotally mounted door of a compartment, such as an interior compartment of a vehicle.

2. Prior Art

Interior compartments with pivotally mounted doors have traditionally been provided in the forward portion of cars and trucks. These compartments are for the storage of articles which are useful to the driver and passengers. For example, glove boxes have been provided in most cars and trucks. Currently, additional compartments are also being provided in other locations such as the lower forward console and the like for storage of various additional items such as audio tapes, garage door openers and the like.

In accordance with the present invention, a latching mechanism is provided which is fixed to the top of the door frame and engages a fixed striker cam located on the top edge of the door. The door is spring-loaded outwardly and moves in and out relative to the latch-spring assembly. The latch spring follows a complete cycle around the striker cam when the door is opened and then closed. The latch system may be referred to as a "push-push" latch.

A push-push latch system inherently opens upon vehicle jolting caused by bumps in the road. Upon such jolting, the compartment door experiences an inertia loading which may cause an inward deflection of the door. This deflection of the door may allow the latch system to move to an unlatched condition, which is of course desired in accordance with the present invention, although not as a result of random jolting of the vehicle.

In order to prevent opening of the door under conditions of vehicle jolting, a spring stop has been provided which must receive positive unlatching pressure before the door will open.

The use of striker cam means with spring loaded latching structure is known, as exemplified by British Pat. No. 1,188,996, G. H. Moody et al, Apr. 22, 1967 and U.S. Pat. No. 3,189,374, June 15, 1965. However, such structures have not been proposed in the past for a pivotal vehicle compartment door with structure to prevent undesired unlatching.

CROSS-REFERENCE TO RELATED APPLICATION

The present application is related to my co-pending application Ser. No. 780,865, filed Sept. 27, 1985.

SUMMARY OF THE INVENTION

A latching mechanism for a pivotally mounted door of an interior compartment of a vehicle is provided. The latching mechanism includes spring means which are mountable between the door and the compartment for biasing the door to open. A latch spring arm is mountable within the compartment. A striker cam plate is mountable on the door. A latching element is carried by the latch spring arm. The striker cam plate has a first cam surface positioned to contact a latching element upon pushing of the door closed against the action of the spring means and cause the latching element to cam thereon with resultant deflection of the latch-spring arm permitting full closure of the door. The striker cam plate has a first cam lobe at the termination of the first cam surface. The latching element passes over the first cam lobe upon full closure of the door.

The striker cam plate has a second cam lobe and a depression between the cam lobes. A detent is mountable on the door in alignment with the depression. The detent blocks passage of the latching element after it passes the first cam lobe with the door fully closed. The door is biased to a slightly open position by the spring means after pushing on the door ceases. The detent moves out of blocking position upon such slight opening of the door permitting the latching element to be moved into the depression between the cam lobes as a consequence of the biasing action of the deflected latch spring arm.

The second cam lobe blocks passage of the latching element after it moves into the cam depression with the door in a slightly open position to thereby latch the door in a closed position. The second cam lobe moves out of blocking position upon again pushing of the door to the fully closed position against the action of the spring means. This permits the latching element to pass over the second cam lobe as a consequence of the biasing action of the deflected latch spring arm to unlatch the door.

Spring stop means are mountable on the door and positioned to block further passage of the latching element after it passes the detent and moves into the cam depression to prevent passage of the latching element over the second cam lobe upon inadvertent movement of the door. A depressible lever is mountable on the door to engage and move the spring stop out of the way when it is desired to open the door. Slot means are provided on the cam to receive the spring stop when it is engaged and moved by the lever.

BRIEF DESCRIPTION OF A PREFERRED EMBODIMENT

Figure 1:
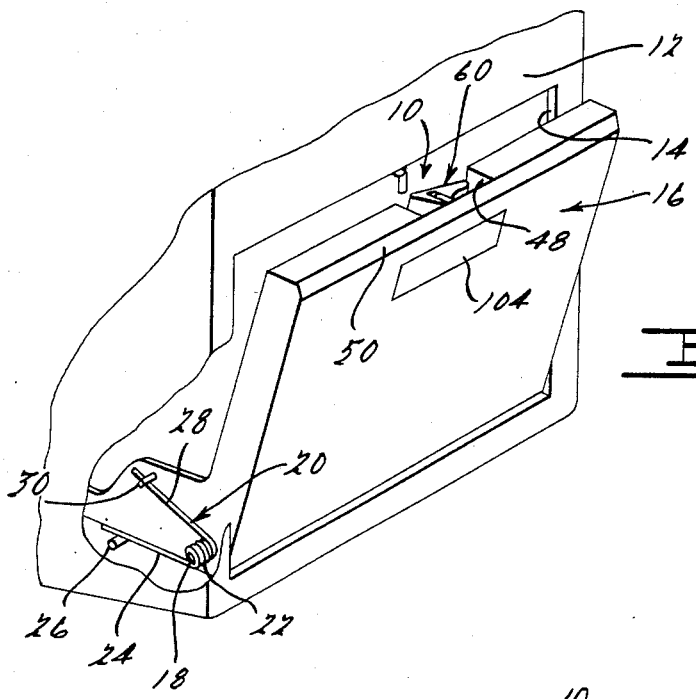
FIG. 1 is a view in perspective of a vehicle interior compartment with the door partially open and with the latching mechanism forming one embodiment of the present invention mounted thereon.

The latching mechanism 10 of the present invention is adapted for use in connection with an interior compartment 12 of a vehicle, such as a glove box, such as are conventionally provided in vehicles such as automobiles and trucks. Such compartments are normally provided on the instrument panel or consoles in the forward portion of the vehicle. The compartment 12 has an access opening 14 which is normally closed by a door 16. The door 16 is pivotally mounted at 18 to the structure of the compartment 12 so that it may be pivoted from the open to the closed position.

A spring 20 biases the door 16 towards the open position. The spring 20 functions to maintain the door 16 in the latched condition when the door is closed and as an aid to easy opening of the door after it has been unlatched. The spring 20 has a central coiled section 22 which is received on pivot structure 18. One arm 24 extends from coil 22 to a position over a pin 26 which is mounted on the structure of the compartment 12. A second arm 28 extends from the coil 22 beneath a second pin 30 which is mounted on the compartment door 16. The arms 24, 28 are constrained by the pins 24, 30 to cause the coil 22 to tighten thus constantly exerting a force tending to spread the arms 24, 28 apart to thereby bias the door 16 toward the open position.

The construction of the latching mechanism 20 may best be seen in FIGS. 2, 7, 8 and 9. As will be therein noted, the latching mechanism 10 includes an elongated latch arm 44 which is provided on the upper surface of the compartment. The latch arm 44 is pivotally secured to compartment structure 32 by means of a pivot member 34. The arm 44 has a pointed portion 35 which extends from the pivot 34 and terminates at a point above a notch 48 which is provided on the upper edge of the compartment door 16. The notch 48 faces towards the interior of the compartment with a solid portion 50 of the door 16 masking the notch from external view. The arm 44 has a downwardly extending cam follower element 52 which extends into notch 48. A pair of longitudinally spaced apart pins 56, 58 (FIG. 2) are secured to the underside of the structure 32. One pin 56 is provided on one side and adjacent to a spring arm 36 while the other pin 58 is provided on the other side and adjacent the spring arm 36. The spring arm 36 is secured in place by a rivet 38 which is secured to structure 32.

A downturned portion 40 of the spring arm 36 extends into a slot 42 provided in rectangular portion 46 of the latch arm 44. The pins 56, 58 serve as positioning elements to center the spring arm 36, when undeflected, in a preselected position as will be noted in FIG. 2. The downturned portion 40, which rides in slot 42 during pivoting of the latch arm 44, maintains the latch arm 44 in the same alignment. The arm 44 may be deflected in either direction in the latching and unlatching procedure but will always tend to return to the position shown in FIG. 2. This feature forms part of the latching and unlatching system.

A striker cam plate 60 is provided in the notch 48. The plate 60 has a first cam surface 62 which faces the spring arm 44. The cam surface 62 is angled outwardly from the compartment extending from a point 64, which is adjacent to the cam follower element 52 upon initial closing of the door 16, to a point 66 within the notch 48. A cam lobe 68 is therein provided. The cam lobe 68 is followed by a depression 70 which faces outwardly with respect to the compartment. A detent element 72 is secured within the notch 48 and is oppositely disposed and spaced from the depression 70. The depression 70 terminates in a second cam lobe 74. A cam surface 76 extends from lobe 74 at an angle back to the cam surface 62 joining the surface at the point 64 which thereby defines the apex of oppositely inclined converging cam surface 62, 76.

Figure 2:
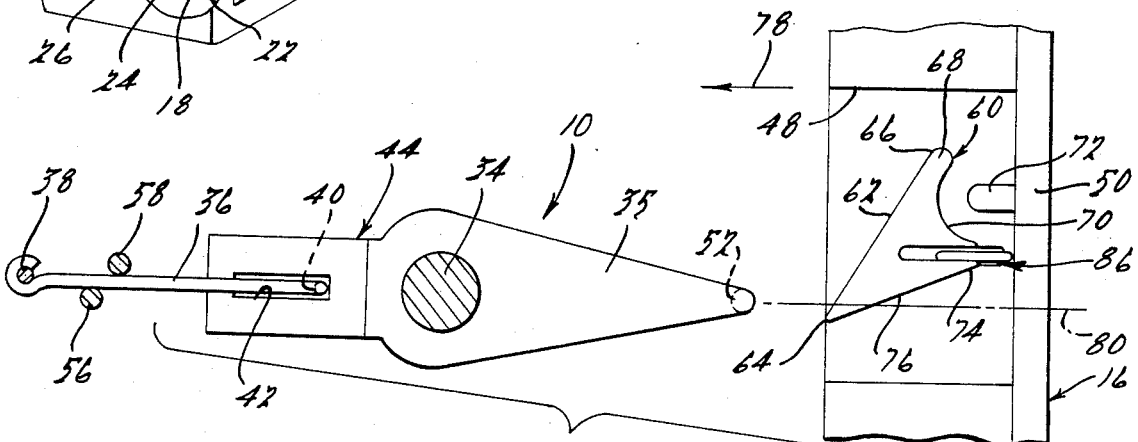
FIG. 2 is a top plan view of the latching mechanism illustrating the condition thereof just prior to closing of the door.
Figure 3:
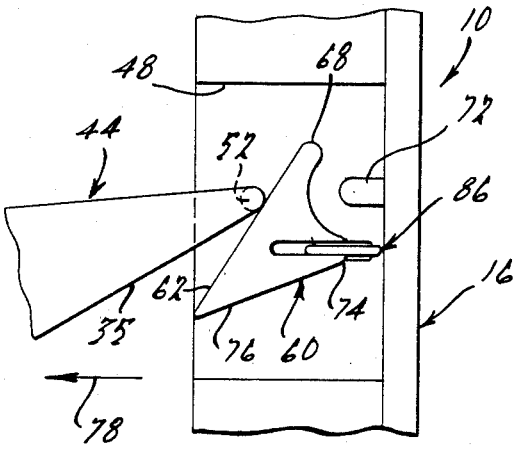
FIG. 3 is a top plan view similar to FIG. 2 illustrating the first stage of latching upon closing of the door.
Figure 4:
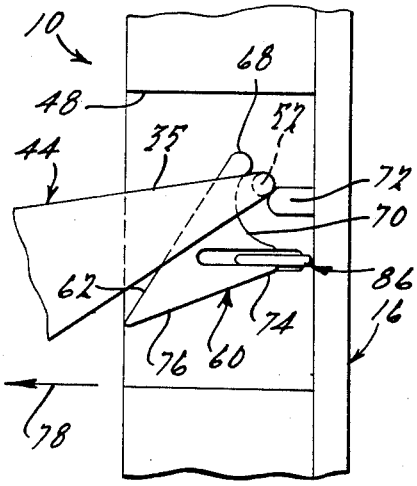
FIG. 4 is a top plan view similar to FIG. 2 illustrating the second stage of latching upon closing of the door.

The latching and unlatching action may now be understood. With the door 16 in the open position as shown in FIG. 2, the cam follower element 52 is directly in line with the cam surface 62 at a point slightly offset from the apex 64. When the door 16 is moved in the direction of arrow 78 by a manual push in opposition to the force of spring 20, the cam follower element 52 will eventually contact cam surface 62 and move along this cam surface as shown in FIG. 3. This movement will cause deflection of the latching arm 44 as illustrated in FIG. 3. As the door 16 is pushed further inwardly, as shown in FIG. 4, in the direction of arrow 78, the cam follower element 52 will pass over the cam lobe 68 and into the depression 70. However, the detent element 72 will obstruct movement of the cam follower element 52 from entirely entering the depression 70 until the closing pressure is released.

As will be noted in FIG. 2, the center line of the latch arm 44 when undeflected in its preselected position, as represented by the line 80, projects just past the second cam lobe 74. As will be recalled, the arm 44, which is offset from the center of the cam plate 60, normally assumes the position shown in FIG. 2. Thus, if the detent element 72 were not provided, the door 16 would not be latched because, with the door 16 pushed in, the latch arm 44 would continue to travel past the cam lobe 74 if it were not restrained by the detent element 72.

After the manual pressure used to close the door 16 is released, the spring 20 biases the door 16 in the direction of arrow 82 towards the open position. The door 16 moves slightly towards the open position allowing the cam follower element 52 to pass by the detent element 72 into the depression 70. However, the cam follower element 52 cannot now pass over the lobe 74 because the lobe 74 has been moved away from the cam follower element to the position shown which is beyond the length of the latch arm 44 thus preventing unlatching.

Figure 6:
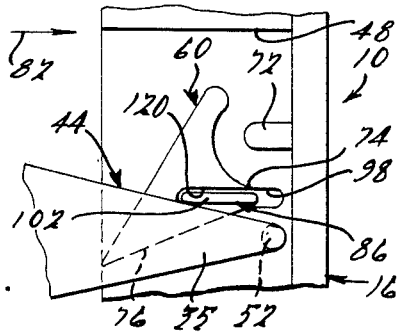
FIG. 6 is a top plan view similar to FIG. 2 illustrating unlatching of the door.
Figure 7:
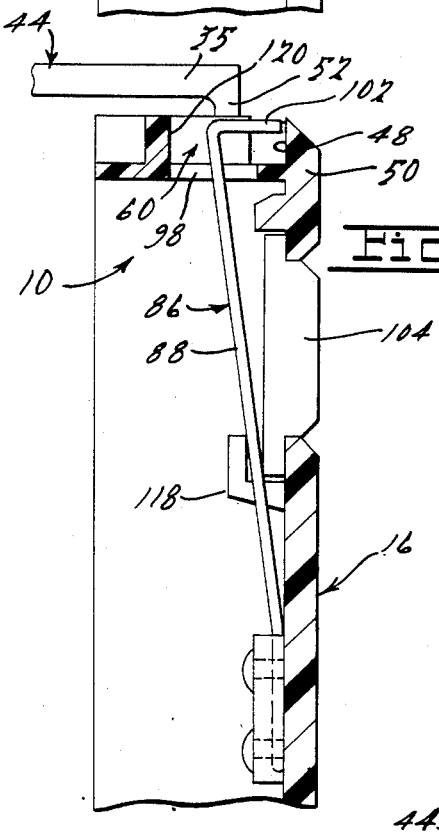
FIG. 7 is a side elevational view in section of the latching mechanism with the door in the closed and latched position.
Figure 8:
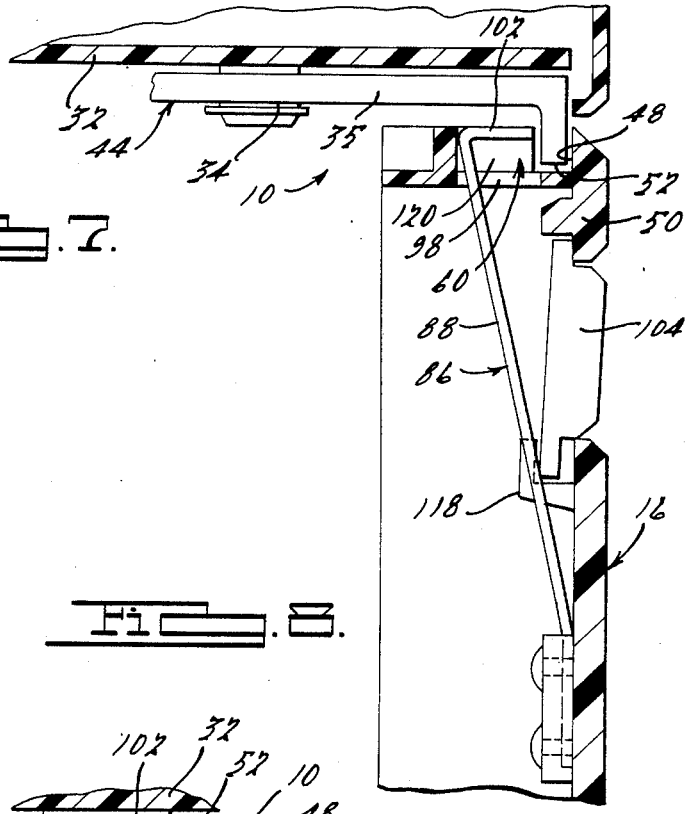
FIG. 8 is a side elevational view in section illustrating unlatching.
Figure 9:
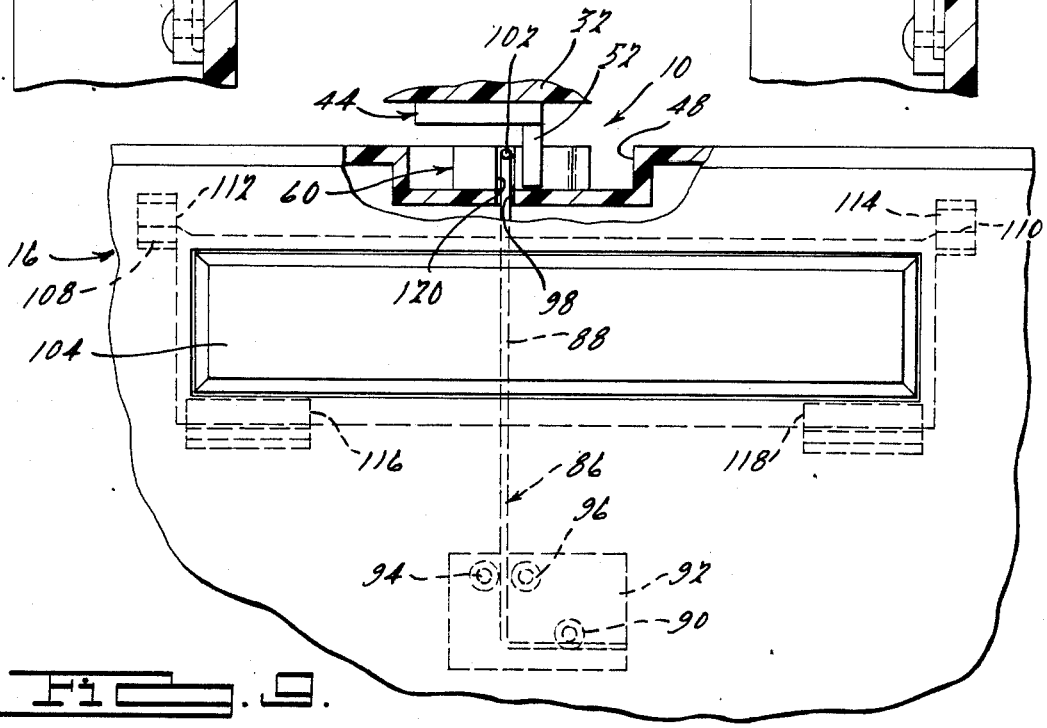
FIG. 9 is a front view of the door with portions broken away for the purpose of clarity.

When it is desired to open the door 16, the door is again pushed in the direction of arrow 78. The cam lobe 74 is thus moved closer to the cam follower element 52. In this position, it is possible, because of the length of the arm 44, for the cam follower element 52 to pass over the lobe 74. As soon as it passes over the lobe 74, and upon release of the door 16, the door 16 will move in the direction of arrow 82 as shown in FIG. 6, towards the open position. The cam follower element 52 will then pass over the cam lobe 76 as shown in FIG. 6.

Spring stop means 86 are provided on the door 16 to block passage of the latch arm 44 to prevent opening of the door 16 excepting when positive action is taken by a person who wishes door 16 to open. Inward deflection of the door 16 as a result of a jolt to the vehicle may allow the latch system to move to an unlatched condition. The spring stop 86 requires positive pressure to cause deflection thereof before the door will open.

Figure 5:
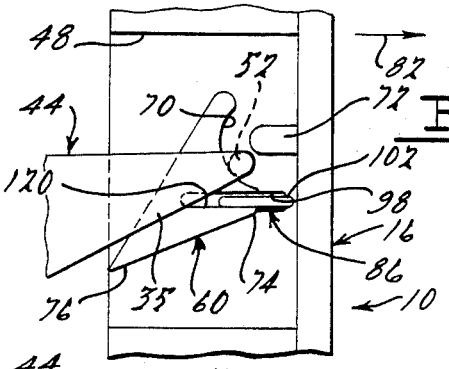
FIG. 5 is a top plan view similar to FIG. 2 illustrating the door in the closed and latched condition.

As will be noted in the figures, particularly FIGS. 5–9, the spring stop means 86 comprises a spring arm 88 having an L-shaped lower end which is secured to the inner surface of the door 16 by means of a fastener 90 provided on a plate 92 which is attached to the door 16 by fasteners 94, 96. The arm 88 extends through a slot 98 provided in the notch wall and thence for a distance equal to about the thickness of the striker cam plate 60. The arm 88 extends at an angle away from the door 16 and has a bent over stop portion 102 which extends back towards the door 16. The portion 102 functions as a stop. Referring to FIGS. 5 and 6, should the door 16 be jolted inwardly, the cam follower element 52 could theoretically pass by cam lobe 74. However, this can't happen because the stop portion 102 will prevent it from happening.

A depressible lever 104 is provided in opening 106 of door 16 to permit manual deflection of the spring arm 88 and thus unlatching of door 16. The lever 104 is pivotally mounted to the door 16 at the upper outer edges by means of pins 108, 110 which are received in brackets 112, 114 which are secured to the door. The lever 104 may be pivoted inwardly by manual pressure applied thereto from the outside of the door. A pair of stop brackets 116, 118 are provided on the lower outer edges of the door frame adjacent to the opening 106 to limit movement of the lever. A slot 120 is provided in cam plate 60 to receive the spring arm 88 and stop portion 102.

When it is desired to open door 16, the lever 104 is depressed. This will cause the lower edge of the lever to pivot inwardly and deflect the spring arm 88 to the position shown in FIG. 8 where the stop portion 102 is out of the way of cam follower element 52. Pressure on lever 104 also causes the door 16 to pivot inwardly thereby permitting cam follower element 52 to pass over cam lobe 74. The door will thus be unlatched and will open.

I claim:

1. A latching mechanism for a pivotally mounted door of an interior compartment of a vehicle, spring means mountable between the door and the compartment for biasing the door to open, a latch spring arm mountable within the compartment, a striker cam plate mountable on the door, a latching element carried by the latch spring arm, the striker cam plate having a first cam surface positioned to contact the latching element upon pushing of the door to close against the action of the spring means and cause the latching element to cam thereon with resultant deflection of the latch spring arm permitting full closure of the door, the striker cam plate having a first cam lobe at the termination of the first cam surface, the latching element passing over the first cam lobe upon full closure of the door, the striker cam plate having a second cam lobe and a depression between the cam lobes, the door being biased to a slightly open position by the spring means after pushing thereon ceases, the latching element moving into the depression between the cam lobes upon such slight opening of the door as a consequence of the biasing action of the deflected latch spring arm, the second cam lobe blocking passage of the latching element after it moves into the cam depression and with the door in a slightly open position to thereby latch the door in a closed position, the second cam lobe moving out of blocking position upon again pushing of the door to the fully closed position against the action of the spring means thereby permitting the latching element to pass over the second cam lobe as a consequence of the biasing action of the deflected latch spring arm to unlatch the door, spring stop means mountable on the door and positioned to block disengagement of the latching element and the catch means, and a manually depressible lever mountable on the door and positioned to engage and move the spring stop means out of the way when it is desired to open the door.

2. A latching mechanism as defined in claim 1, further characterized in that the spring stop means includes a spring arm mountable on the door, a turned over portion on the spring arm positioned to engage the latching element, the striker element including a slot to receive the turned over portion upon movement of the spring stop means by the lever.

3. A latching mechanism for a pivotally mounted door of an interior compartment of a vehicle, spring means mountable between the door and the compartment for biasing the door to open, a latch spring arm mountable within the compartment, a striker cam plate mountable on the door, a latching element carried by the latch spring arm, the striker cam plate having a first cam surface positioned to contact the latching element upon pushing of the door to close against the action of the spring means and cause the latching element to cam thereon with resultant deflection of the latch spring arm permitting full closure of the door, the striker cam plate having a first cam lobe at the termination of the first cam surface, the latching element passing over the first cam lobe upon full closure of the door, the striker cam plate having a second cam lobe and a depression between the cam lobes, a detent mountable on the door in alignment with the depression, the detent blocking passage of the latching element after it passes over the first cam lobe with the door fully closed, the door being biased to a slightly open position by the spring means after pushing thereon ceases, the detent moving out of blocking position upon such slight opening of the door permitting the latching element to be moved into the depression between the cam lobes as a consequence of the biasing action of the deflected latch spring arm, the second cam lobe blocking passage of the latching element after it moves into the cam depression and with the door in a slightly open position to thereby latch the door in a closed position, the second cam lobe moving out of blocking position upon again pushing of the door to the fully closed position against the action of the spring means thereby permitting the latching element to pass over the second cam lobe as a consequence of the biasing action of the deflected latch spring arm to unlatch the door, spring stop means mountable on the door and positioned to block disengagement of the latching element and the catch means, and a manually depressible lever mountable on the door and positioned to engage and move the spring stop means out of the way when it is desired to open the door, the spring stop means including a spring arm mountable on the door, a turned over portion on the spring arm to engage the latching element, the striker element including a slot to receive the turned over portion upon movement of the spring stop means by the lever.

* * * * *